US005354129A

United States Patent [19]

Yowell

[11] Patent Number: 5,354,129

[45] Date of Patent: Oct. 11, 1994

[54] MIXING-CUTTING PADDLE

[76] Inventor: Donald H. Yowell, 1520 Lindberg Rd., Bethlehem, Pa. 18017

[21] Appl. No.: 208,737

[22] Filed: Mar. 10, 1994

Related U.S. Application Data

[63] Continuation-in-part of Ser. No. 105,118, Aug. 12, 1993.

[51] Int. Cl.[5] ..... B01F 7/18

[52] U.S. Cl. ..... 366/343; 241/282.1; 241/282.2

[58] Field of Search ..... 366/342, 343, 344, 345, 366/279, 325, 331, 129, 64; 241/282.1, 282.2, 199.12

[56] References Cited

U.S. PATENT DOCUMENTS

| | | | |
|---|---|---|---|
| 832,052 | 10/1906 | Fritz | 366/129 |
| 832,504 | 10/1906 | Sandall | 366/129 |
| 948,750 | 2/1910 | Washburn | 416/70 |
| 1,368,180 | 2/1921 | Nakamura | 366/343 |
| 1,548,041 | 8/1925 | Johnston | 366/197 |
| 1,651,276 | 11/1927 | Hood | 366/129 |
| 1,656,665 | 1/1928 | Dehuff | 366/197 |
| 1,774,509 | 9/1930 | Gould | 366/197 |
| 4,735,510 | 4/1988 | Barbour | 366/343 |

*Primary Examiner*—Robert W. Jenkins
*Attorney, Agent, or Firm*—James R. Bell

[57] ABSTRACT

A paddle is used for mixing and cutting. A hub is at one end of the paddle for connecting the paddle to a planetary mixing machine. The paddle includes a plurality of interconnected arms in a fan-like array which define a plurality of slots between adjacent arms. The arms include a plurality of apertures formed therethrough. Outermost ones of the arms are positioned at opposite sides of the paddle. A plurality of wire members are secured at their opposite ends to the outermost arms. The wire members extend through the apertures formed in the arms and across the slots defined between the arms. The combination of the arms, the wire members extending through the apertures formed in the arms and across the slots defined between the arms, forms a plurality of multidirectional mixing and cutting components of the paddle.

14 Claims, 2 Drawing Sheets

MIXING-CUTTING PADDLE

This is a continuation-in-part of U.S. patent application Ser. No. 105, 118, filed Aug. 12, 1993, for DYETS Mixing-Cutting Paddle, by Donald H. Yowell, the inventor in the present patent application.

FIELD OF THE INVENTION

This invention relates generally to a paddle for use with a mixing machine and more particularly to such a paddle having both mixing and cutting components.

BACKGROUND OF THE INVENTION

In mixing operations, especially when blending fat and starch materials used in the food industry, various paddle configurations have been provided for use with planetary mixing machines where the mixed end product is a dry or essentially dry homogeneous powdery-type mixture. By essentially dry is meant that the mixture feels dry to the touch and also appears dry, although some small amounts of moisture may have been added during the mixing operation.

Using such paddles, insufficient cutting of some material will occur and a homogeneous mixture will not be produced. As a result, lumps or chunks of uncut material will remain in the mixture and, no matter how long some materials are mixed, these lumps would not disappear. If a wire whip is used, there will be insufficient structural strength to mix some materials. Wire whips are used for light whipping applications of liquids such as when air is to be incorporated into light batches. The incorporation of air into the dry mixture of the present application is undesirable. Therefore, wire mixing devices are of insufficient strength and totally inappropriate for mixing operations where the mixed end product is a dry or essentially dry homogeneous powdery-type mixture.

The foregoing illustrates limitations of the known prior art. Thus, it is apparent that it would be advantageous to provide an alternative directed to overcoming one or more of the limitations as set forth above. Accordingly, a suitable alternative is provided including features and benefits more fully disclosed hereinafter.

SUMMARY OF THE INVENTION

In one aspect of the present invention, this is accomplished by providing a mixing-cutting paddle comprising a hub at one end of the paddle. A plurality of paddle arms include a fan-like array of interconnected arms defining a plurality of slots between the arms. Outermost ones of the arms are at opposite sides of the paddle. A wire member is secured to the arms. The wire member extends across a slot defined between the outermost arm and an adjacent one of the mixing arms. In this manner, the combination of the arms, and the wire member extending across the slot, forms a plurality of multidirectional mixing and cutting components of the paddle for producing an essentially dry, homogeneous, powdery-type mixture.

The foregoing and other aspects will become apparent from the following detailed description of the invention when considered in conjunction with the accompanying drawing figures. It is to be expressly understood, however, that the figures are not intended as a definition of the invention, but are for the purpose of illustration only.

BRIEF DESCRIPTION OF THE DRAWING FIGURES

DETAILED DESCRIPTION OF THE INVENTION

Figure 1:
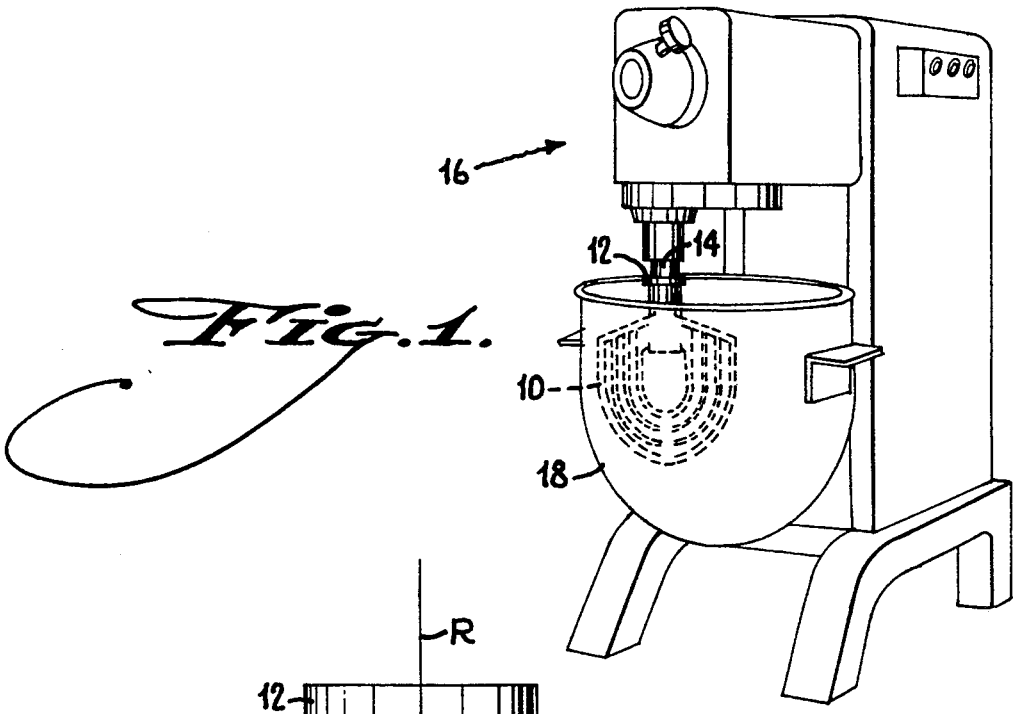
FIG. 1 is a view illustrating an embodiment of the mixing-cutting paddle of the present invention being used with a planetary mixing machine.

Referring now to the drawings, FIG. 1 illustrates the paddle 10 of the present invention connected at hub 12 to a drive shaft 14 of a typical, well-known planetary type mixer 16. The standard hub 12 to shaft 14 connection permits interchange of various mixing paddles. A container 18 holds material to be mixed by paddle 10 as the paddle 10 rotates, being driven by shaft 14 while simultaneously revolving in a planetary manner so that the desired mixing is accomplished in container 18.

Figure 2:
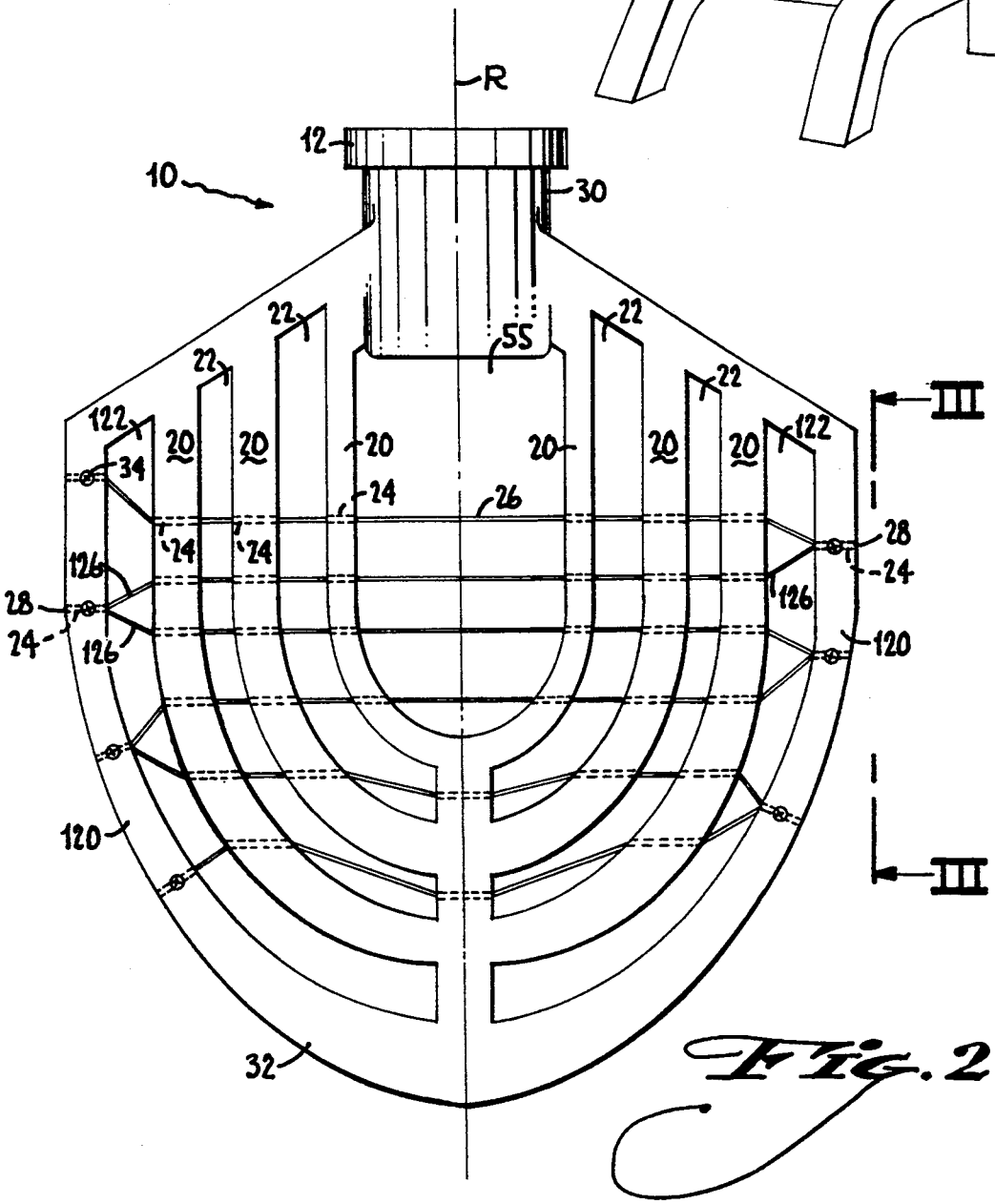
FIG. 2 is a view illustrating an embodiment of the mixing-cutting paddle of the present invention.

In FIG. 2, it is shown that hub 12 is at one end of paddle 10. A plurality of paddle arms include a fan-like array of interconnected arms 20 which define a plurality of slots 22 there between. Arms 20 include a plurality of apertures 24 formed therethrough. Outermost ones of arms are at opposite sides of paddle 10 and are designated 120.

A plurality of wire members 26 are secured at their opposite ends 28 in the apertures 24 formed in the outermost arms 120. The wire members 26 extend through the apertures 24 formed in arms 20 and 120 and across the slots 22 defined between the arms 20 and 120. In this manner, the combination of the arms 20, 120 and the wire members 26 form a plurality of multidirectional mixing and cutting components of paddle 10.

More specifically, hub 12 is at a first end 30 of paddle 10. Arms 20, 120 extend longitudinally, side-by-side from their interconnection at first end 30 of paddle 10 and converge to be interconnected at second end 32 of paddle 10, thereby defining longitudinally extending slots 22 between the longitudinally extending arms 20, 120.

Figure 3:
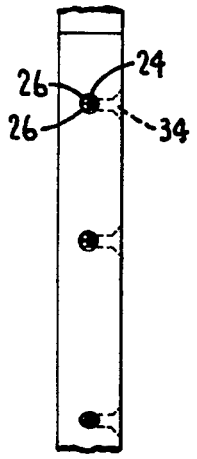
FIG. 3 is a partial side view of the paddle taken along line 3—3 of FIG. 2.

Wire members 26 are strung transversely through the apertures 24 formed to extend transversely through the longitudinally extending arms 20, 120. Hence, wire members 26 also extend transversely through the slots 22 defined between arms 20, 120. Each wire member 26 includes a diagonal component 126 as it extends through the outermost ones of the slots 122 adjacent the outermost arms 120. Means, such as set screws 34, are provided to secure the opposite ends 28 of wire members 26 in the apertures 24 of the outermost arms 120. It is preferable to countersink set screws 34 into outermost arm member 120, best shown in FIG. 3.

Wire members 26 thus form a plurality of longitudinally spaced apart, transversely extending rows as they pass through corresponding rows of apertures 24. The apertures 24 formed in the outermost arms 120 are longitudinally offset from the apertures 24 in the arms 20. Due to this offset, the diagonal components 126 of adjacent ones of the wire members 26 are formed as the adjacent wire members 26 converge into a common aperture 24 in the outermost arms 120, where they are secured by set screws 34. The wire members 26 are preferably formed of stainless steel and have a diameter of about 0.023 inches.

The mixing-cutting paddle 10 of the present invention may be used for mixing operations in the food industry, the pharmaceutical industry or the chemical industry, and is particularly useful for blending fat with starch, but facilitates mixing of relatively small amounts of liquid with an insoluble, finely divided powder where the end mixed product is a dry or essentially dry homogeneous powdery-type mixture. The paddle 10 simultaneously mixes and cuts with enhanced efficiency. The arrangement, number and size of the wire members 26 may be varied somewhat, however, it has been noted that the diagonal components 126 of the wire members 26 are most effective, especially in the outermost slots 122, due to the greater relative speed generated between that area of the paddle 10 and the material being mixed. In fact, the wire members 26 can be totally eliminated in the region of the paddle 10 which lies along the rotational axis R of the hub 12 since there is little relative speed between this area of the paddle 10 and the material being mixed, for example see FIGS. 4 and 5.

The unique mixing-cutting paddle of this invention combines the structural strength of the beater arms so that greater mixing speeds can be used, and the combination of wires of a small diameter, extending across the slots defined between the beater arms, enhances cutting and helps prevent oxidation. The wires must be of small enough diameter to enhance cutting, but of sufficient strength so as not to break during mixing. Not only do the wires allow difficult materials to be cut while being mixed, they produce a mixing process which is completely homogeneous and efficient when combined with the strong beater arms of the mixing paddle. Unexpectedly, the mixing-cutting paddle of this invention maximizes the chemical integrity of the mixture by minimizing oxidation.

Figure 4:
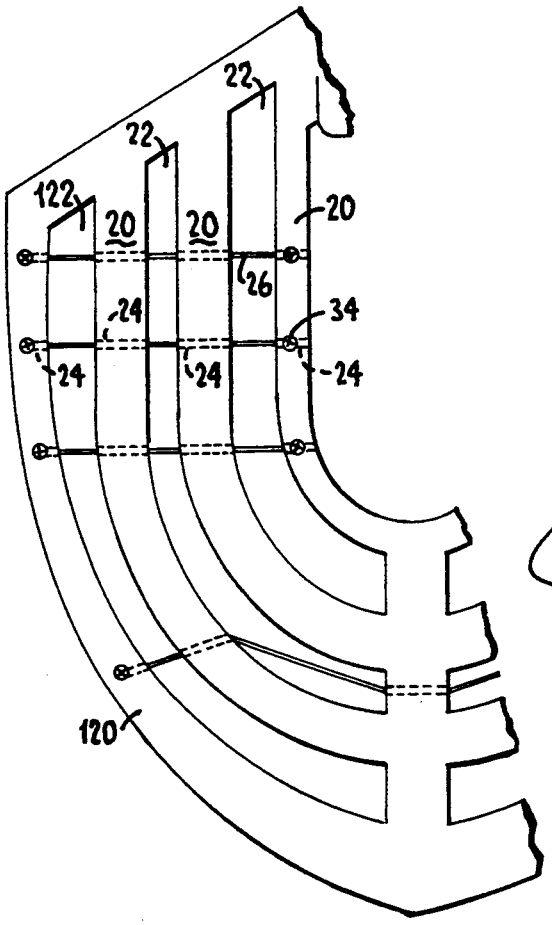
FIGS. 4 and 5 illustrate partial views of alternative embodiments of the mixing-cutting paddle of the present invention.
Figure 5:
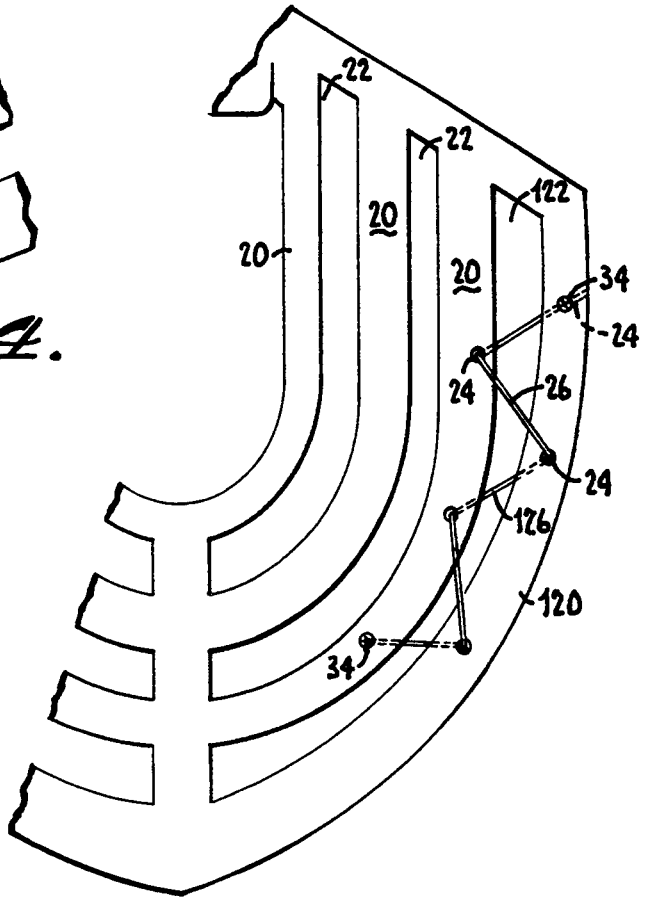

FIGS. 4 and 5 illustrate alternative ways to string wire members 26 in paddle 10. In FIG. 4, wire members 26 do not include diagonal components 126, but are strung in substantially a straight line between an arm 20 and outermost arm 120. The wire members 26 extend through apertures 24 in arms 20, 120 and across slots 22, 122 and are secured at their opposite ends by set screws 34.

In FIG. 5, wire members 26 do include diagonal components 126 which are strung only across outermost slot 122, the most effective mixing and cutting area, between outermost arm 120 and an adjacent arm 20. Wire member 26 extends through apertures 24 in arms 20, 120 and opposite ends of wire member 26 are secured in arms 20, 120 by set screws 34.

While this invention has been illustrated and described in accordance with a preferred embodiment, it is recognized that variations and changes may be made therein without departing from the invention as set forth in the claims.

Having described the invention, what is claimed is:

1. A mixing-cutting paddle comprising:

a hub at one end of the paddle;

a plurality of mixing paddle arms including a fan-like array of interconnected arms defining a plurality of slots therebetween, outermost ones of the arms being at opposite sides of the paddle; and a cutting wire member secured to the mixing arms, the cutting wire member extending across a slot defined between the outermost arm and an adjacent one of the mixing arms, whereby the combination of mixing arms, and cutting wire member extending across the slot as aforesaid, forms a plurality of multidirectional mixing and cutting components of the paddle for producing an essentially dry, homogeneous, powdery-type mixture.

2. The paddle as defined in claim 1 wherein a plurality of cutting wire members are secured to the mixing arms and extend through apertures formed in the mixing arms, and adjacent ones of the cutting wire members converge to be secured in a common aperture in the outermost mixing arms.

3. The paddle as defined in claim 2 wherein the cutting wire members are formed of stainless steel.

4. The paddle as defined in claim 3 wherein the cutting wire members have a diameter of about 0.023 inches.

5. The paddle as defined in claim 4 wherein the cutting wire members are secured in the outermost mixing arms by a set screw.

6. A mixing-cutting paddle comprising:

a hub at a first end of the paddle;

a plurality of paddle arms including a fan-like array of longitudinally extending arms interconnected at the hub and extending therefrom, the arms being side-by-side and spaced apart defining longitudinally extending slots therebetween, the arms converging and being interconnected at a second end of the paddle opposite the first end, outermost ones of the arms being at opposite sides of the paddle;

a plurality of wire members strung transversely through apertures formed in the arms and extending transversely through the slots, each wire member including a diagonally extending portion as it extends through outermost ones of the slots adjacent the outermost arms; and means for securing opposite ends of each wire member in the outermost arms.

7. The paddle as defined in claim 6 wherein adjacent ones of the wire members converge to be secured in a common aperture in the outermost arms.

8. The paddle as defined in claim 7 wherein the wire members are secured in the outermost arms by a set screw.

9. The paddle as defined in claim 8 wherein the wire members are formed of stainless steel.

10. The paddle as defined in claim 9 wherein the wire members have a diameter of about 0.023 inches.

11. A mixing-cutting paddle comprising:

a hub at a first end of the paddle;

a plurality of paddle arms including a fan-like array of longitudinally extending arms interconnected at the hub and extending therefrom, the arms being side-by-side and spaced apart defining longitudinally extending slots therebetween, the arms converging and being interconnected at a second end of the paddle opposite the first end, outermost ones of the arms being at opposite sides of the paddle, each arm including a plurality of transversely extending apertures formed therethrough, the apertures forming a plurality of longitudinally spaced apart, transversely extending rows of apertures, the apertures in the outermost arms being offset from the rows;

each row of apertures having a wire, respectively, extending therethrough, the wire also extending transversely across each slot, thus forming a plurality of transversely extending wire rows;

each wire having an opposite end, one end of each wire extending into an aperture in one outermost arms offset from the respective wire row, and the other end of each respective wire extending into an aperture in the opposed outermost arm which is also offset from the respective wire row, whereby adjacent ones of the wires converge to a common aperture in the outermost arms; and means for securing the opposite ends of each wire in the outermost arm members.

12. The paddle as defined in claim 11 wherein the means for securing the ends of the wire members includes a set screw.

13. The paddle as defined in claim 12 wherein the wire members are formed of stainless steel.

14. The paddle as defined in claim 13 wherein the wire members have a diameter of about 0.023 inches.

* * * * *